US006648758B2

(12) United States Patent
Bennett et al.

(10) Patent No.: US 6,648,758 B2
(45) Date of Patent: Nov. 18, 2003

(54) GAMING MACHINE WITH PLAYER CHOICE BONUS GAMES

(75) Inventors: Nicholas Bennett, Lane Cove (AU); Christopher Stevens, Lane Cove (AU)

(73) Assignee: Aristocrat Technologies Australia Pty Ltd., Lane Cove (AU)

( * ) Notice: Subject to any disclaimer, the term of this patent is extended or adjusted under 35 U.S.C. 154(b) by 112 days.

(21) Appl. No.: 09/912,727

(22) Filed: Jul. 25, 2001

(65) Prior Publication Data

US 2002/0025846 A1 Feb. 28, 2002

(30) Foreign Application Priority Data

Jul. 27, 2000 (AU) ..... PQ9042

(51) Int. Cl.[7] ..... A63F 9/24
(52) U.S. Cl. ..... 463/20; 463/16
(58) Field of Search ..... 463/10–13, 16–23, 463/25–28, 30, 31

(56) References Cited

U.S. PATENT DOCUMENTS 6,231,442 B1 * 5/2001 Mayeroff ..... 463/20
6,416,406 B1 * 7/2002 Duhamel ..... 463/12
6,419,579 B1 * 7/2002 Bennett ..... 463/20
6,443,837 B1 * 9/2002 Jaffe et al. ..... 463/16

* cited by examiner

*Primary Examiner*—Tony M. Argenbright
(74) *Attorney, Agent, or Firm*—Katten Muchin Zavis Rosenman

(57) ABSTRACT

A gaining machine has a display means and a game control means arranged to control images displayed on the display means. The game control means is arranged to play an underlying game in which random events are caused to be displayed on the display means. In the feature game series, which is distinct from the underlying game played on the machine that is triggered during play of the underlying game, a set of special indicia are provided which may have specific functions during the feature game series such as acting as wild, substitute, scatter symbols or the like. Prior to commencement of playing of the games of the feature game series, the gaming machine allows the player of the gaming machine to select at least one particular special indicia from the set of special indicia to have at least one of the particular functions during that feature game series.

16 Claims, 6 Drawing Sheets

GAMING MACHINE WITH PLAYER CHOICE BONUS GAMES

FIELD OF THE INVENTION

This invention relates to a gaming machine. More particularly, the invention relates to a gaming machine and to an improvement to a game played on such a gaming machine.

BACKGROUND TO THE INVENTION

Players who regularly play gaming machines quickly tire of particular games and therefore it is necessary for manufacturers of these machines to develop innovative game features which add interest to the games. In so doing, it is hoped to keep players amused and therefore willing to continue playing the game as well as to attract new players.

Also, with the growth that has occurred in the gaming machine market, there is intense competition between manufacturers to supply various existing and new venues. When selecting a supplier of gaming machines, the operator of a venue will often pay close attention to the popularity of various games with their patrons. Therefore, gaming machine manufacturers are keen to devise games which are popular with the players as a mechanism for improving sales, retaining customers and attracting new customers.

SUMMARY OF THE INVENTION

In a first aspect of the present invention, there is provided a gaming machine having a display means and a game control means arranged to control images displayed on the display means, the game control means being arranged to play an underlying game wherein one or more random events are caused to be displayed on the display means and, if a predefined winning event occurs, the machine awards a prize, the gaming machine being characterised in that a feature game series distinct from the underlying game played on the machine may be triggered in which feature game series a set of indicia are provided which have specific functions or attributes during the feature game series and wherein prior to commencement of playing the games of the feature Same series the player is allowed to select which indicia from the set of indicia has at least one of the particular functions or attributes during the feature game series.

In one embodiment, the player is allowed to select the indicia that will act as a substitute symbol during the feature Same series. Substitute symbols are "wild" symbols which may also multiply wins by a particular factor.

Alternatively, the player may be allowed to select the symbol that acts as the scatter symbol during the feature fame series. Alternatively, the player may be allowed to choose both the substitute and scatter symbols which should be different symbols.

There may be a cost required relating to the choice that the player makes. For example, the player may pay one additional credit prior to commencement of the bonus game to allow for a special symbol to become a substitute symbol during the bonus games. The player may also be allowed to choose the function of special symbols during the bonus games (eg. scatter, wild, any pays).

In one embodiment, the player may choose to add extra symbols to the feature games that did not appear in the basic game.

The symbols may have different functions and/or different win multiplication values as substitute symbols.

In an alternative embodiment, at the end of the feature game series, the players winnings are increased dependent on the number of times a particular indicia has appeared in the display during the feature game series, and the player is allowed to select that particular indicia from the set of indicia prior to commencement of the feature game series.

In one particular embodiment, the feature game series may show a race and the selection of the indicia made by the player may be the selection of the winner of the race from the participants. The participants in the race may be, for example, cars or horses. The player may also be able to choose the volatility of the game by choosing the number of participants in the race with the prize for winning being greater with a greater number of participants. Prizes may be awarded if the chosen participant comes second or third in the race.

In an alternative embodiment, the prize for first place may not change with the number of participants in the race. However, the number of places that are awarded prizes may depend upon the number of participants selected by the player.

In a second aspect of the present invention, there is provided a gaming machine having a display means and game control means arranged to control images displayed on the display means, the game control means being arranged to play a game wherein one or more arrays of indicia are caused to be displayed on the display means, and, if a predefined winning event occurs, the machine awards a prize, the gaming machine being characterised in that a feature game series may be initiated on the machine either on the occurrence of a predetermined event or by some other trigger means in which feature game series at least two reels provide special indicia which both substitute for other indicia in the display and multiply any win when the special indicia substitutes for other indicia characterised in that the player may select the factors by which the wins will be multiplied when the special indicia substitutes on a particular reel.

Typically, the special indicia will be provided on two of the reels of the feature game. The player may have the choice of factor A for one of the reels, factor B for the second of the reels wherein the product A×B preferably is always the same number with A and B varying for each of the reels. Typically A and B are integers.

In a yet further aspect of the present invention, there is provided a gaming machine having a display means and game control means arranged to control images displayed on the display means, the game control means being arranged to play game wherein one or more arrays of indicia are caused to be displayed on the display means and if a redefined winning event occurs, the machine awards a prize, the gaming machine being characterised in that a feature game series may be initiated on the machine either on the occurrence of a predetermined event or by some other trigger means in which a feature game series the player is allowed to choose the quantity of a certain symbol that appears on the reels or virtual reels of the gaming machine during the feature game series.

In one embodiment, the feature game series may provide a series of special indicia having specific monetary values and the monetary value shown is paid to the player when the particular indicia appears on the display means either individually, or in some embodiments when in a special combination. The player is allowed to choose the number of such special symbols on a video reel. However, the value of each symbol decreases as the number of special indicia on the virtual reels increases

BRIEF DESCRIPTION OF THE DRAWINGS

The invention is now described by way of example with reference to the accompanying diagrammatic drawings in which.

DETAILED DESCRIPTION OF THE PREFERRED EMBODIMENTS AND EXAMPLES

Figure 1:
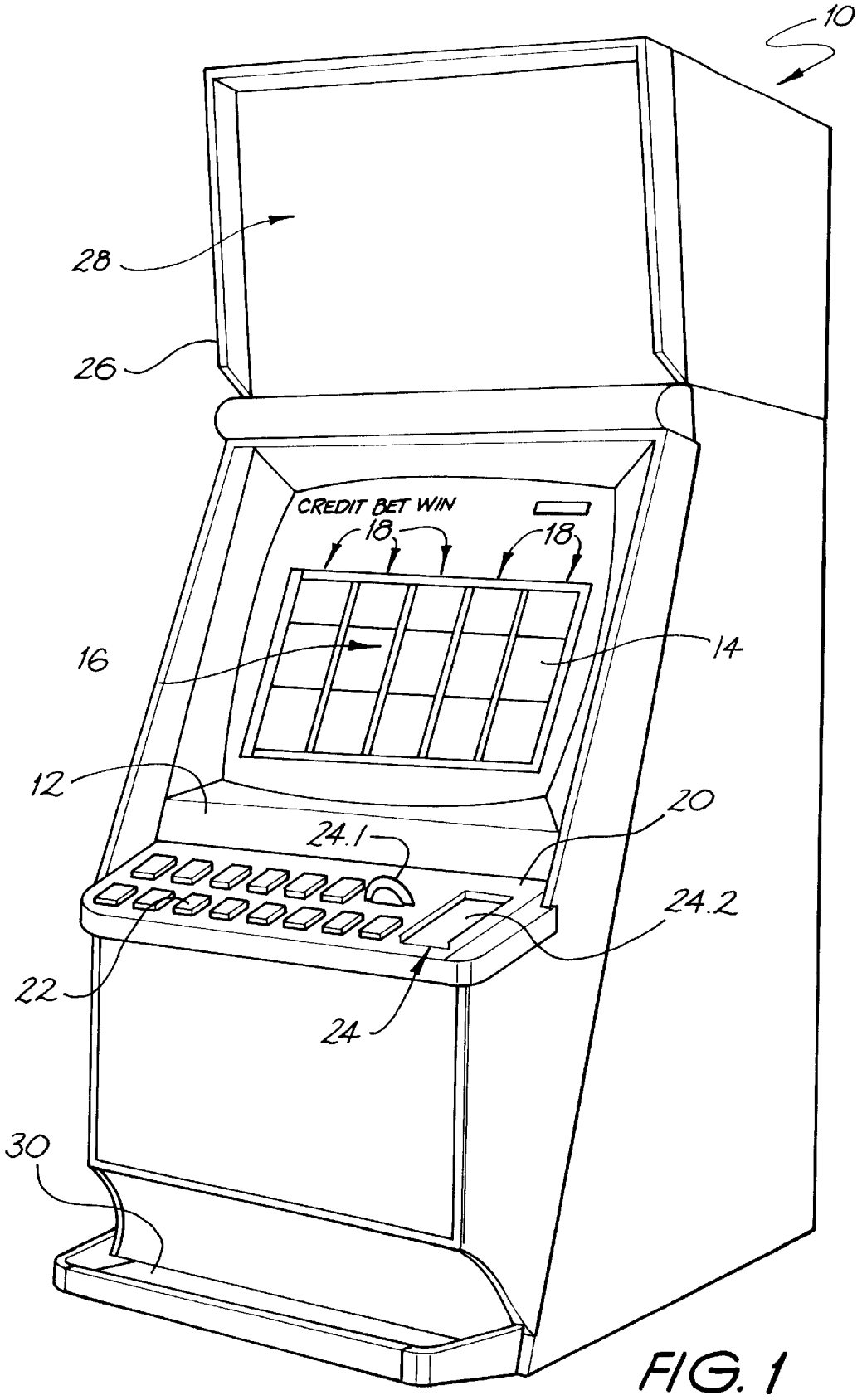
FIG. 1 shows a three dimensional view of a gaming machine, in accordance with the invention.

In FIG. 1, reference numeral 10 generally designates a gaming machine, including a game, in accordance with the invention. The machine 10 includes a console 12 having a video display unit 14 on which a game 15 is played, in use. The preferred form of a base game of the game 16 is a spinning reel game which simulates the rotation of a number of spinning reels 18. It will, however, be appreciated that the invention is equally applicable to other types of base games such as card games or ball games such as Keno, or the like. A midtrim 20 of the machine 10 houses a bank 22 of buttons for enabling a player to play the game 16. The midtrim 20 also houses a credit input mechanism 24 including a coin input chute 24.1 and a bill collector 24.2.

The machine 10 includes a top box 26 on which artwork 28 is carried. The artwork 28 includes paytables, details of bonus awards, etc.

A coin tray 30 is mounted beneath the console 12 for cash payouts from the machine 10.

Figure 2:
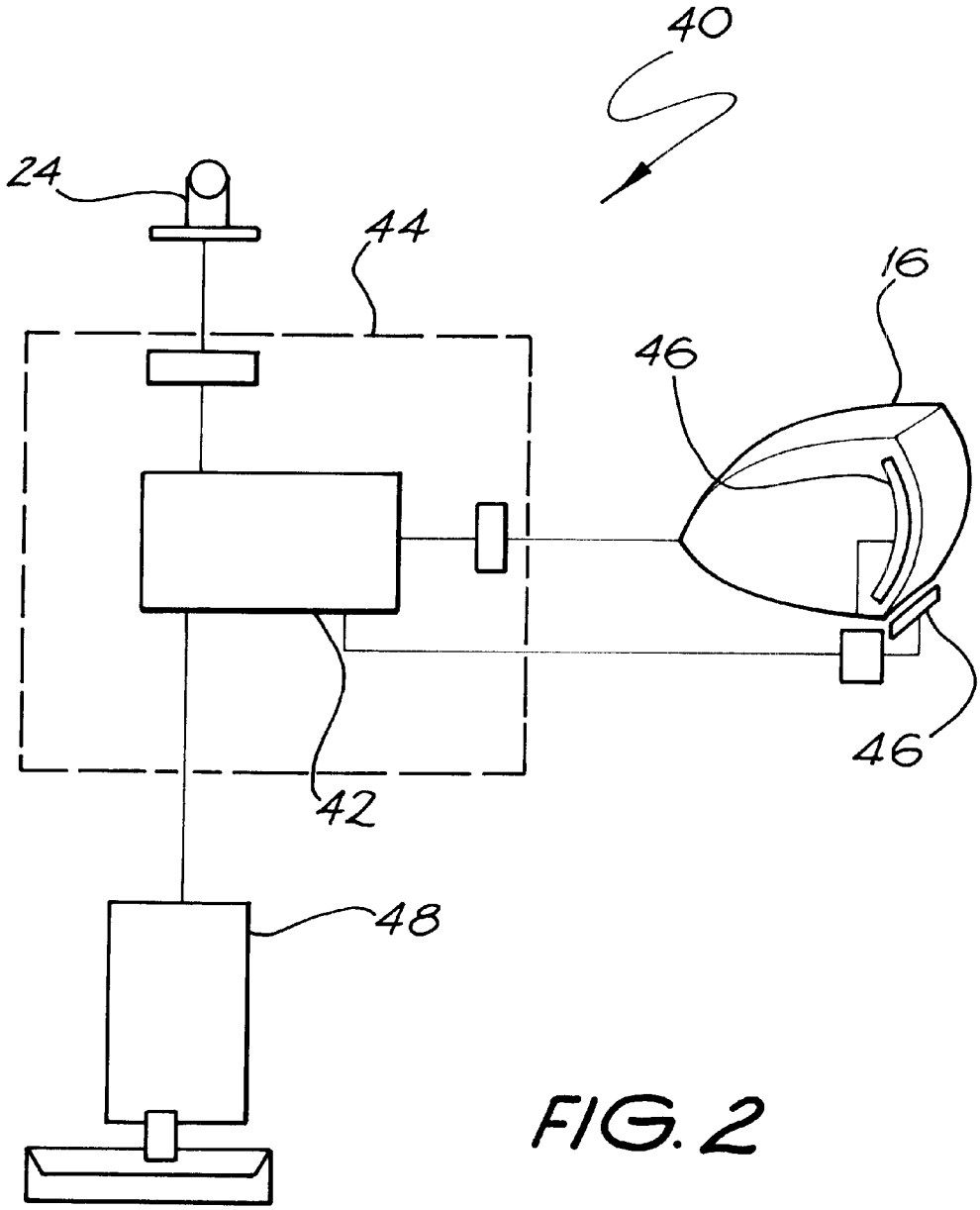
FIG. 2 shows a block diagram of a control circuit of the gaming machine.

Referring now to FIG. 2 of the drawings, a control means or control circuit 40 is illustrated. A program which implements the game and user interface is run on a processor 42 of the control circuit 40. The processor 42 forms part of a controller 44 which drives the screen of the video display unit 14 and which receives input signals from sensors 46. The sensors 46 include sensors associated with the bank 22 of buttons and touch sensors mounted in the screen 16. The controller 44 also receives input pulses from the mechanism 24 indicating that a player has provided sufficient credit to commence playing. The mechanism 24 may, instead of the coin input chute 24.1 or the bill collector 24.2, or in addition thereto, be a credit card reader (not shown) or any other type of validation device.

Finally, the controller 44 drives a payout mechanism 48 which, for example, may be a coin hopper for feeding coins to the coin tray 30 to pay a prize once a predetermined combination of symbols carried on the reels 18 appears on the screen 18 or some other prize winning event occurs.

The player plays the base game, typically a video reel game (a video simulation of spinning reels) as discussed above. The novel game feature of the present invention relates to a feature game series which is triggered on the occurrence of a predetermined combination of symbols on the display, or at random, or by some other process.

The feature games will typically be a bonus series of free games also spinning reel games, however they may be games which the player has to buy.

Most video reel poker games are now "themed" and include a series of picture or feature symbols which are typically specific to that game and usually include special symbols such as scatter, bonus, weld, substitute symbols or the like. For example, a game which has Egypt as its theme, may have Cleopatra, a pyramid, a sphinx, a hieroglyph and a gold ring as picture symbols.

The feature game series, may, for example, be triggered by the appearance of a specific picture symbol on the first reel and a different specific picture symbol on the last reel.

However before the feature games commence the player is given a choice relating to how the feature games will function. This increases player interest in the game as it allows the player more control over the game.

However, the choices offered will be structured so that the theoretical percentage returns to the player are roughly the same, whatever choices are made. One choice made by the player may be either to pick a particular favourite symbol as a bonus symbol. The player may alternatively be offered choices which affect the volatility of the game.

The choices which may be offered to the player may include the choice of the multipliers applicable to substitute wins. For example reels 2 and 4 of the video reel game may provide special symbols, typically picture symbols as discussed above which substitute for other symbols ie act as "wild" cards or substitute symbols. The player may be allowed to select the amounts (factors) by which wins will be multiplied when the special symbol substitutes in a win on reels 2 and 4 as: 2× and 10×; or 4× and 5×; or 10× and 2×; or 5× and 4×; or 20× and 1×. The product of the two factors is typically always 20 or some other fixed number. This reduces the manipulations required in calculating the expected overall return to the player for each of the options. This variant allows the player to favour a particular lucky reel or make the feature game series more volatile by selecting say 20× and 1×.

During a feature game series, the gaming machine may maintain a separate win meter for the credits won during the feature game series. The machine will also record the number of times (n) a special symbol, typically one of the picture symbols, appears on the display. The amount on the separate win meter is then repeated n times (i.e. multiplied by (n+1)). In the present invention the player is allowed to choose the special symbol from the picture symbols. This allows the player more input into the game and allows them to choose a symbol they believe to be lucky for them.

In a third variant, or in addition to the first two features described above, the player may choose the symbols that will act as the substitute and/or scatter symbols during the feature game series. Again, this choice is typically made from the game's set of picture symbols.

There may be a cost associated with the choice that the player makes. For example, the player may pay one additional credit prior to commencement of the bonus game to allow for a special symbol to become a substitute symbol during the bonus games. The player may also be allowed to choose the function of special symbols during the bonus games (e.g. scatter, wild, etc).

In one embodiment, the player may choose to add extra symbols to the feature games that did not appear in the base game.

In a further variant to the game, the player choice may alter the quantity of a certain symbol that appears on the virtual reels of the video reel game. For example, the game may provide special money symbols carrying dollar amounts. In one embodiment, the respective amount will be paid whenever the special money symbol appears on the display. In some embodiments, the special money symbol may have to spin up in a special combination. The player may choose the volatility of the game by choosing to have one $100 symbol on the reel rather than say ten $10 symbols on the reel. Although the probability of getting the $100 symbol is theoretically a tenth of the probability of getting the $10 symbol, the prize if the player wins is of course, ten times greater.

Figure 8:
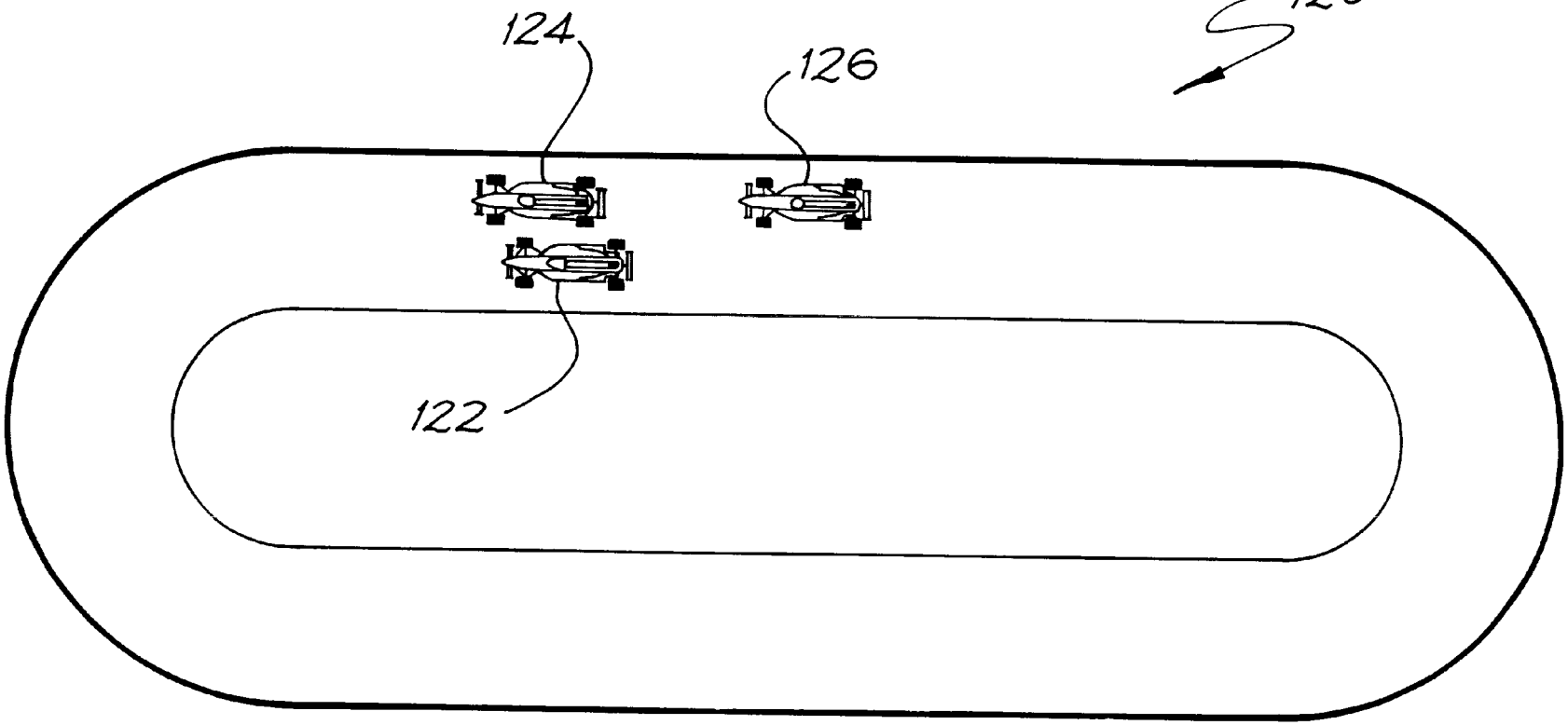
FIG. 8 is a schematic diagram illustrating a car race.

It a yet further embodiment, as illustrated in FIG. 8, the present invention envisages that the bonus game may be a second screen feature which shows, for example, a race which may be a car race 120. The player may choose the participant in the form of a car that they think may win the race. The player may also affect the volatility of the game by choosing the number of cars in the race. For example, in one embodiment, by having three cars 122, 124, 126, in the race, the player will have a ⅓ chance of their car coming first, but the prize awarded for first place is less than it would have been had the player chosen to have ten cars involved in the race. Prizes relating to the chosen car coming second or third may also depend on the number of cars in the race and are greater, the greater the number of cars selected by the player.

In a variant, the first place prize may be the same regardless of the number of cars in the race. However, the number of places second, third, fourth etc, that also receive prizes, depends on the number of cars in the race. Hence, if there are three cars in a race, only the first place may pay, whereas if ten cars were in the race, the game may pay down to fourth place.

There now follows a description of first and second examples of games played on gaming machines embodying aspects of the present invention and of display screens associated with the playing of those games.

EXAMPLE 1

Figure 3:
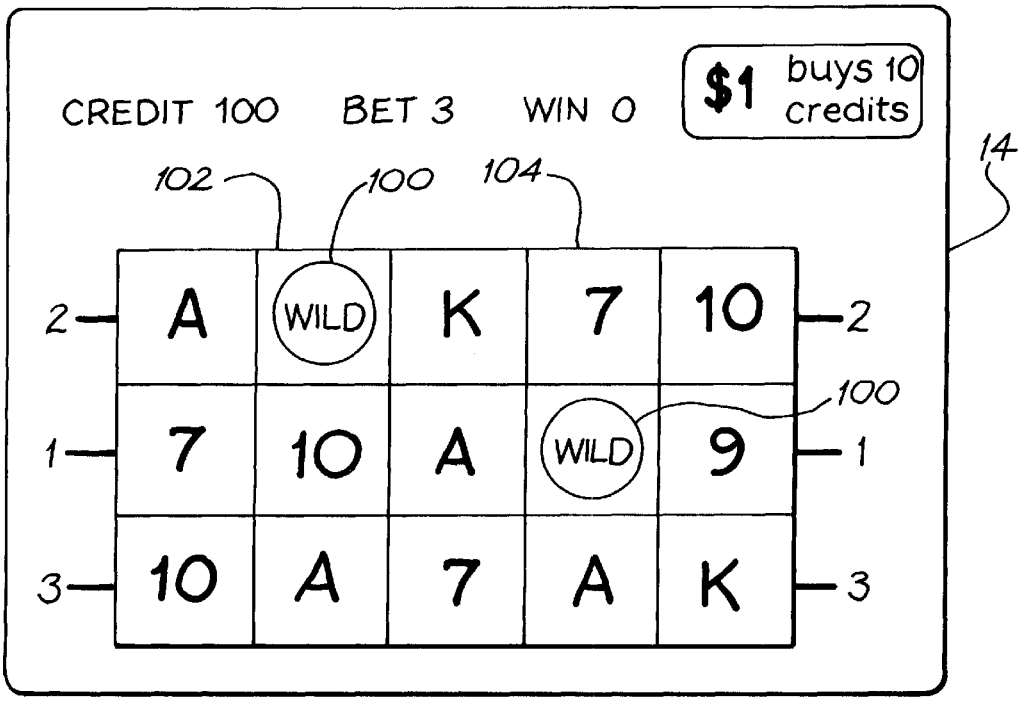
FIG. 3 shows a trigger screen of a first exemplary machine playing a game according to the present invention.
Figure 4:
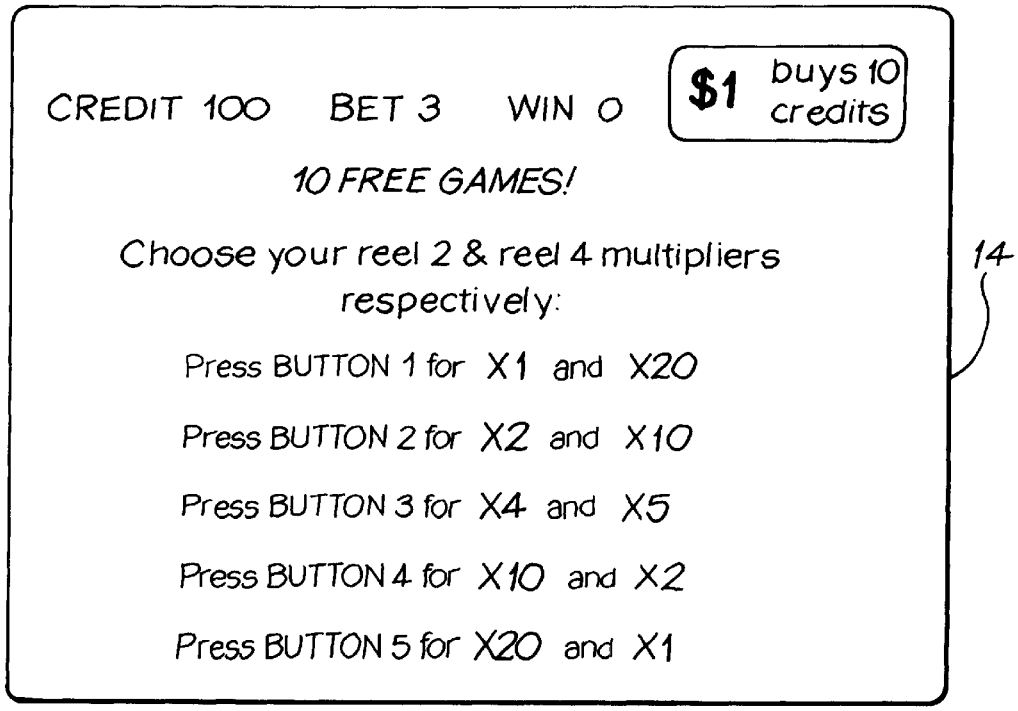
FIG. 4 shows a player choice screen for the game of the first machine.

FIG. 3 shows a display screen of a first game having three paylines 1, 2, 3. Prizes are paid for combinations of three or more of the same symbol appearing left to right or right to left on a payline. The wild symbol 100 substitutes for all symbols and only appears on reels 2 (102) and 4 (104). If two wild symbols 100 appear on the display screen 14 at the same time, the feature game series is triggered. FIG. 3 shows the appearance of two wild symbols 100 triggering the feature game series. The display 14 then changes to a player choice screen illustrated in FIG. 4. The choices offered to the player are the choice of the multipliers applicable to substitute wins such as described in the general description of the game set out above (The options are slightly different in FIG. 4). If the player presses button 4, then for the duration of the ten free games, the wild symbols on reel 2 and 4 display "×10" and "×2" respectively. Any wins in which the reel 2 wild symbol 100 substitutes, will pay ten times the usual prize for the combination. Similarly, wins in which the reel 4 wild symbol substitutes will pay twice the usual prize. Of course, any win with both wild symbols substituting, will play twenty times the usual prize.

Figure 5:
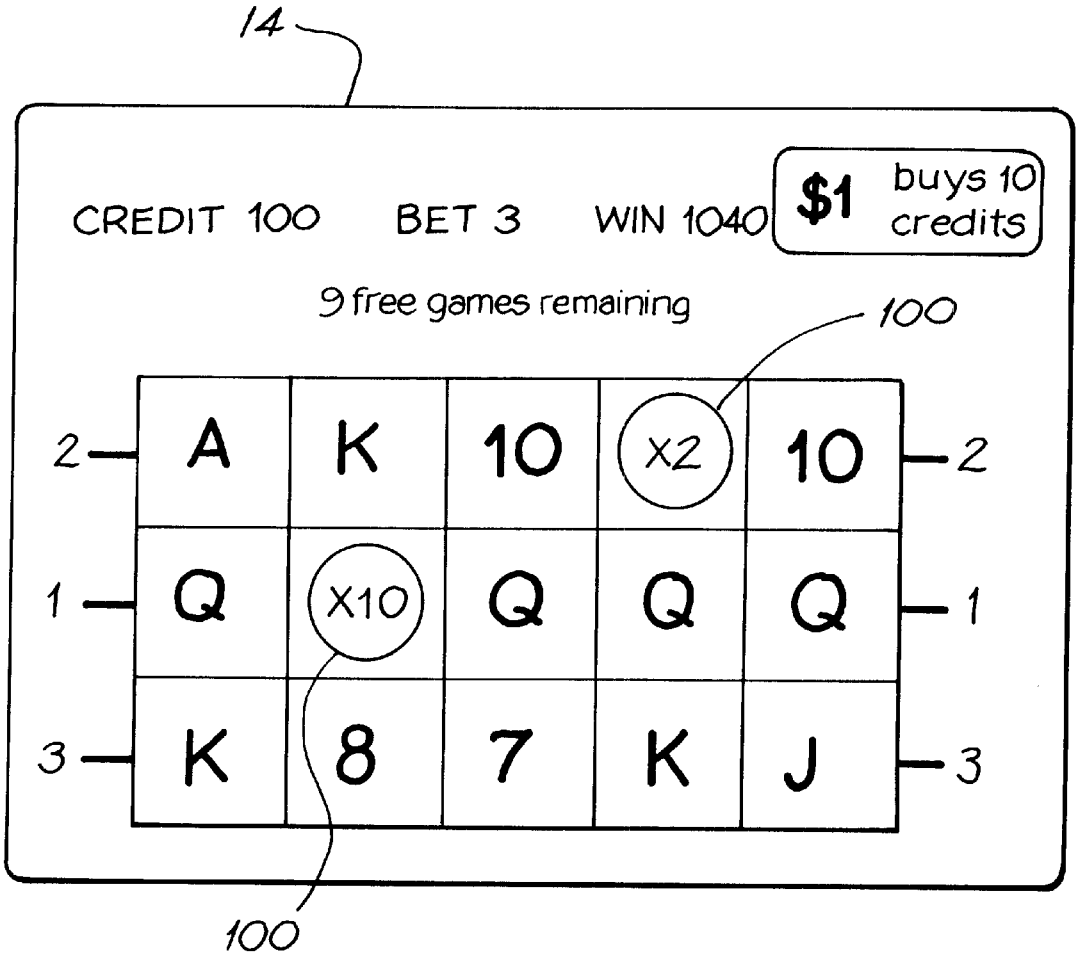
FIG. 5 shows a screen resulting from the first free game of the feature game series of the first example.

For example, the first free game of the feature game series may result in the display shown in FIG. 5. If the wins for 5×Q on payline 1 and 3×10 on payline 2 are normally 100 and 20 respectively, then the combination of 5×Q in FIG. 5 will pay 1,000 credits and the 3×10 will pay 40 credits. In the particular exemplary game, the combination as shown with two wild symbols on the screen at the same time, does not retrigger the bonus game feature. However, in a variant, the appearance of the two wild symbols during the ten free games, could cause the machine to add a further ten free games to those remaining.

After the ten free games of the feature game series have been completed, the wild symbols 100 change to their original form without the multipliers.

EXAMPLE 2

Figure 6:
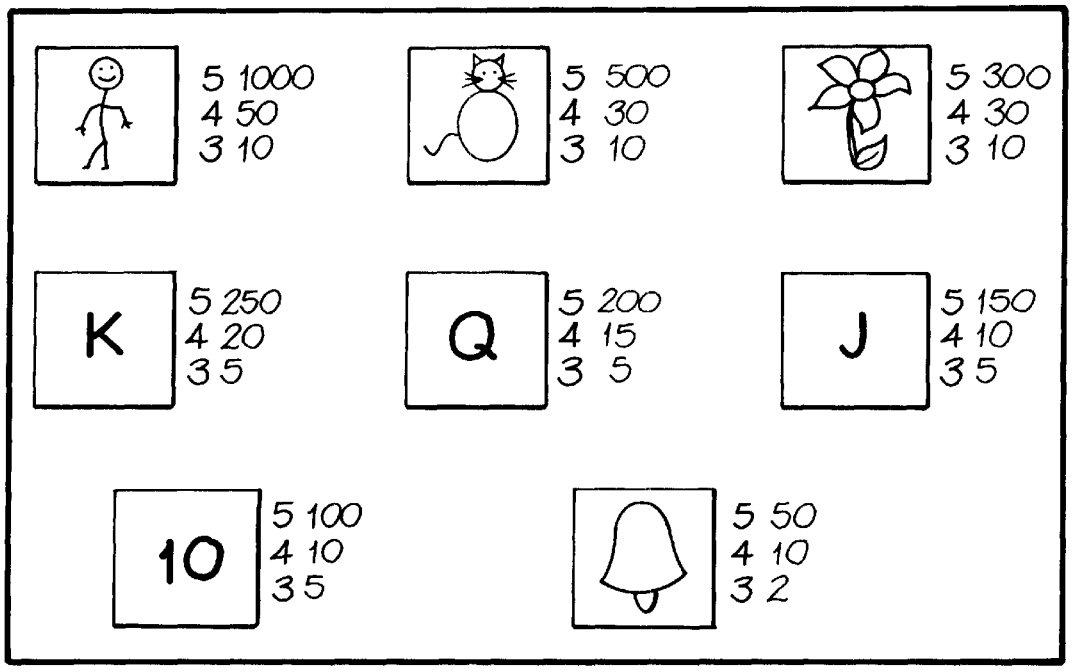
FIG. 6 is a schematic illustration of a pay table for a second exemplary machine playing a game embodying the present invention.
Figure 7:
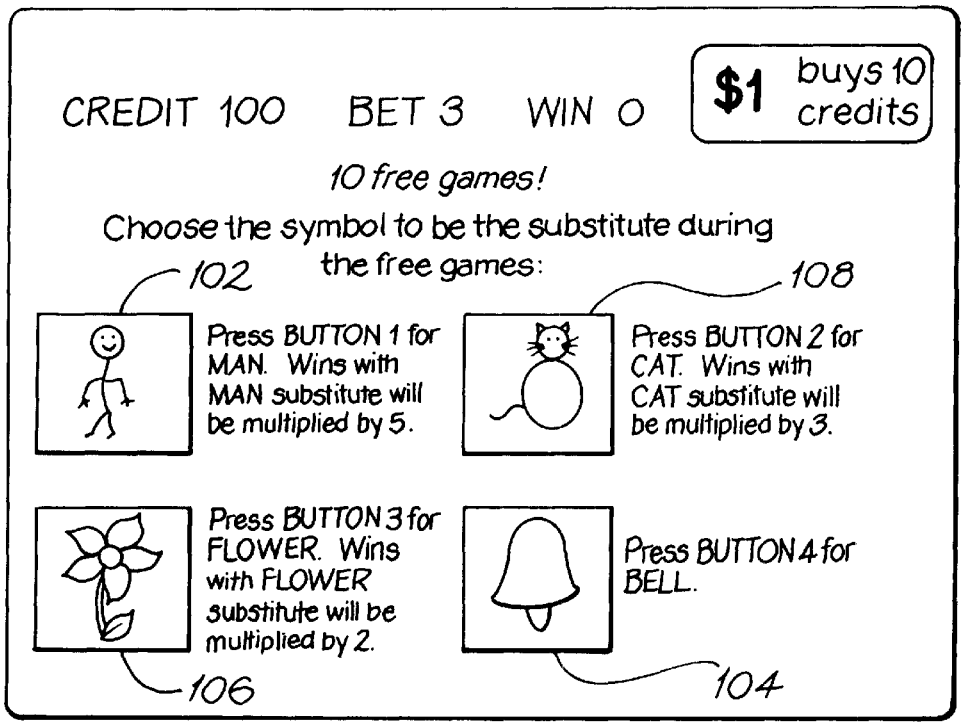
FIG. 7 shows a player choice screen of the second machine when the feature game series has been triggered.

In the game of the second example, the game machine again provides three paylines 1, 2, 3. Prizes are again paid for combinations of three of more of the same symbol appearing from left to right or right to left. FIG. 6 shows an exemplary paytable for the game. FIG. 7 shows a player choice screen which is provided from the triggering of the ten free feature game series. The player may select one of the four picture symbols 102, 104, 106, 108 to substitute for all other symbols while the free games of the feature game series are in progress. Due to the different frequency of occurrence of each of the symbols, the wins with the substitute may be multiplied by different factors. For example, the MAN 102 is the highest paying symbol, there are fewer "MAN" symbols on the reels and therefore MAN is less likely to appear during the free games than the other picture symbols. However, when it does appear in a win, the return for that win would be greater because it will pay the usual prize multiplied by five. Since the BELL 104 is the symbol that appears most frequently, prizes with BELL as substitute will not be multiplied by any factor.

In this embodiment, as well as selecting a lucky symbol, the player is also affecting the volatility of the game as selecting MAN 102 as a substitute symbol will make a win less likely but more rewarding, In a further embodiment, each picture symbol may have a completely different function when it is chosen during the feature game series. For example, if the player chooses FLOWER 106, then FLOWER will pay scattered during the free games, whereas if they were to choose CAT 108, a bonus of five credits may be paid for every CAT symbol that appears during the free games.

In an alternative embodiment, there may be no difference at all between the functions of the symbols and whatever symbol is chosen to be the substitute symbol, there is no multiplication of the win. In this variant, a similar theoretical return to player percentage may still be achieved by changing the reel strips for the feature so that each picture symbol has the same probability of each picture symbol occurring from any one spin.

Thus, the present invention provides a bone in which the player is allowed more input not the game and feels they have more influence over the outcome and can choose a particular symbol which they consider to be lucky and more likely to appear for them, as a special symbol.

It will be appreciated by persons skilled in the art that numerous variations and/or modifications may be made to the invention as shown in the specific embodiments without departing from the spirit or scope of the invention as broadly described. The present embodiments are, therefore, to be considered in all respects as illustrative and not restrictive.

What is claimed is:

1. A gaming machine having a display means and a game control means arranged to control images displayed on the display means, the game control means being arranged to play an underlying game wherein one or more random events are caused to be displayed on the display means and, if a predefined winning event occurs, the machine awards a prize, the gaming machine being characterised in that a feature game series distinct from the underlying game played on the machine may be triggered during play of the underlying game in which feature game series a set of special indicia are provided which may have specific functions or attributes during the feature game series and wherein prior to commencement of playing of the games of the feature game series, the gaming machine is arranged to allow for the selection by a player of the gaming machine, of at least one particular special indicia from the set of special indicia to have at least one of the particular functions or attributes during that feature game series.

2. A gaming machine as claimed in claim 1 wherein the gaming machine is arranged to allow for the player selection of a special indicia to act as a substitute symbol during the feature game series.

3. A gaming machine as claimed in claim 1, wherein the gaming machine is arranged to allow for player selection of a special indicia to act as a scatter symbol during the feature game series.

4. A gaming machine as claimed in claim 1 wherein the gaming machine is arranged to allow for the player selection of a special indicia to act as a bonus symbol during the feature game series.

5. A gaming machine as claimed in claim 1 wherein the gaming machine is arranged to allow for player selection of a special indicia to act as a wild symbol during the feature game series.

6. A gaming machine as claimed in claim 1 wherein the gaming machine is arranged to allow the player to pay additional an credit or credits prior to commencement of the bonus game to allow for a special indicia to become a substitute symbol during the feature game series.

7. A gaming machine as claimed in claim 1 wherein the gaming machine is arranged to allow a player to choose the specific function or attribute of a particular special indicia during the feature game series.

8. A gaming machine as claimed in claim 1 wherein the gaming machine is arranged to allow a player to add additional indicia which do not appear in the underlying game to the feature games.

9. A gaming machine as claimed in claim 1 wherein at the end of the feature game series, the players winnings are increased dependent on the number of times a particular special indicia has appeared in the display during the feature game series, and wherein the gaming machine is arranged to allow the player to choose that particular indicia from the set of special indicia prior to commencement of the feature game series.

10. A gaming machine as claimed in claim 1 wherein the feature game series is a representation of a race and the selection of the special indicia by the player is the selection of one of the participants in the race.

11. A gaming machine as claimed in claim 10 wherein the number of participants in the race may be selected by the player.

12. A gaming machine as claimed in claim 11 wherein the prize for first place does not change with the number of participants in the race, but wherein the number of secondary places that are awarded prizes is dependant on the number of participants selected by the player.

13. A gaming machine as claimed in claim 1 wherein the feature game series is a video simulation of a spinning reel game and provides a series of special indicia having specific monetary values and the monetary value shown is paid to the player when the particular special indicia appears on the display means and wherein the player is allowed to choose the number of such special indicia on the video reels and wherein the value of each special indicia decreases as the number of special indicia on the video reels increases.

14. A gaming machine having a display means and game control means arranged to control images displayed on the display means, the game control means being arranged to play a game wherein one or more arrays of indicia are caused to be displayed on the display means, and, if a predefined winning event occurs, the machine awards a prize, the gaming machine being characterised in that a feature game series may be initiated on the machine either on the occurrence of a predetermined event or by some other trigger means in which feature game series at least two reels provide special indicia which both substitute for other indicia in the display and multiply any win when the special indicia substitutes for other indicia characterised in that the the gaming machine is arranged to allow a player of the gaming machine to select the factors by which the wins will be multiplied when the special indicia substitutes on a particular reel.

15. A gaming machine as claimed in claim 14 wherein the special indicia are provided on two of the reels of the feature game, wherein the product of the two factors is always the same number.

16. A gaming machine having a display means and game control means arranged to control images displayed on the display means, the game control means being arranged to play game wherein one or more arrays of indicia are caused to be displayed on the display means and if a predefined winning event occurs, the machine awards a prize, the gaming machine being characterised in that a feature game series may be initiated on the machine either on the occurrence of a predetermined event or by some other trigger means in which a feature game series the player is allowed to choose the quantity of a certain symbol that appears on the reels or virtual reels of the gaming machine during the feature game series.

* * * * *